United States Patent [19]

Stake et al.

[11] Patent Number: 4,907,697

[45] Date of Patent: Mar. 13, 1990

[54] CONTAINER FOR TRANSPORTING LONG OBJECTS, ESPECIALLY ROLLS FOR PAPERMAKING MACHINES

[75] Inventors: Esbjörn Stake, Hudiksvall; Lennart Magnusson, Iggesund, both of Sweden

[73] Assignee: Mecania AB, Hudiksvall, Sweden

[21] Appl. No.: 377,853

[22] PCT Filed: Dec. 21, 1987

[86] PCT No.: PCT/SE87/00620

§ 371 Date: Jul. 6, 1989

§ 102(e) Date: Jul. 6, 1989

[87] PCT Pub. No.: WO88/05414

PCT Pub. Date: Jul. 28, 1988

[30] Foreign Application Priority Data

Jan. 19, 1987 [SE] Sweden ..... 8700177

[51] Int. Cl.[4] ..... B65D 85/20; B65D 85/66

[52] U.S. Cl. ..... 206/446; 220/1.5; 206/509; 206/596

[58] Field of Search ..... 206/446, 509, 595, 596, 206/1.5

[56] References Cited

U.S. PATENT DOCUMENTS

| | | | |
|---|---|---|---|
| 852,010 | 4/1907 | Wright | 206/446 |
| 2,307,250 | 1/1943 | Winchell | 206/59 |
| 2,828,857 | 4/1958 | MacKay | 206/446 |
| 4,555,023 | 11/1985 | Sykes et al. | 206/446 |
| 4,615,453 | 10/1986 | Taquoi | 220/71 |

FOREIGN PATENT DOCUMENTS

| | | | |
|---|---|---|---|
| 031775 | 7/1981 | European Pat. Off. | 206/446 |
| 0102454 | 3/1984 | European Pat. Off. . | |
| 1934336 | 7/1969 | Fed. Rep. of Germany . | |
| 2280562 | 2/1976 | France . | |
| 1367393 | 9/1974 | United Kingdom | 206/446 |
| 1497929 | 1/1978 | United Kingdom | 206/446 |

OTHER PUBLICATIONS

Derwent's Abstract No. K1770 B/43, SU 644 675, 1/30/79.

Derwent's Abstract No. M2031 E/37, SU 878 622, 11/7/81.

*Primary Examiner*—William Price

*Attorney, Agent, or Firm*—McFadden, Fincham, Marcus & Allen

[57] ABSTRACT

A container (1) for transporting, for example, the rolls of papermaking machines comprises an outer supporting rigid metal frame (3) and a nonsupporting casing (4) protecting the roll, said metal frame comprising an end frame member (5) at each short end of the container, and a side frame member (6) arranged along each of the container long sides and connected to said end frame members (5). The frame is preferably provided with lifting lugs (10) and recesses (8) for the fork arms of a fork-lift truck or the like. The casing comprises a semicylindrical bottom part (14) and one or more top parts (15) which also are semicylindrical and detachably connected to said bottom part (14).

8 Claims, 3 Drawing Sheets

CONTAINER FOR TRANSPORTING LONG OBJECTS, ESPECIALLY ROLLS FOR PAPERMAKING MACHINES

TECHNICAL FIELD OF THE INVENTION

The present invention relates to a container for transporting long, preferably cylindrical objects, especially rolls for papermaking machines, comprising on the one hand an outer supporting rigid metal frame and, on the other hand, a nonsupporting casing protecting the object.

BACKGROUND OF THE INVENTION

Large papermaking machines usually comprise a number of big-sized and unwieldy rolls which must be taken out of the machine at regular intervals and sent away for maintenance. During transport, the rolls must be adequately protected against damage from any external violence. Up to now, specially made wooden boxes have been used for protecting the rolls during transport. However, the disadvantages of these wooden boxes are considerable. They are expensive to manufacture because high demands are placed on the stability and strength of the box, int. al. because of the great weight and length of the rolls. A further factor increasing the cost is that the box must give full protection to the roll surface. Wooden boxes of this type must be regarded, in principle, as expendable packings because they are usually destroyed when the roll is unpacked. This means that the packaging cost for each transport may be on the same order as or higher than the actual transport cost of the roll. Furthermore, a wooden box is not easily handled because it may be difficult to attach the requisite lifting lugs in a manner sufficiently reliable for the great weight of the roll. It may also be difficult to insert the forks of a fork-lift truck or the like underneath the box.

SUMMARY OF THE INVENTION

The present invention aims at providing a container which is suitable for transporting the rolls of papermaking machines or other long, preferably cylindrical objects and which may be reused an indefinite number of times, which is easily handled by, for example, a crane or fork-lift truck and which simultaneously gives adequate protection to the contents. In accordance with the primary characteristic features of the invention, these and other objects are achieved in that the frame comprises end frame members at each short end of the container and side frame members arranged along each of the container long sides and connected to said end frame members, and that the casing comprises both a preferably semicylindrical continuous bottom part which is suspended in the side frame members, and one or more, preferably semicylindrical top parts detachably connected to the bottom part, and that there are provided within said casing at least two clamping devices secured to said side frame members and adapted to fix the object in transport position.

FURTHER ILLUSTRATION OF PRIOR ART TECHNIQUE

U.S. Pat. No. 4,615,453 discloses a transport container of the type mentioned in the introduction, i.e. a container which comprises both a casing and a supporting frame therefor. In this case, however, the casing is in the form of a tank which is covered in all round and which under no circumstances can be used for the storage and transport of long objects, such as heavy rolls.

BRIEF DESCRIPTION OF THE ACCOMPANYING DRAWINGS

In the drawings

DETAILED DESCRIPTION OF A PREFERRED EMBODIMENT OF THE INVENTION

Figure 3:
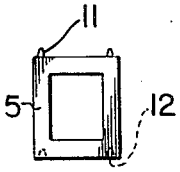
FIG. 3 is an end view of the container.

In the drawings, the transport container according to the invention is designated 1 in its entirety. Within the container, a roll 2 is indicated by dash-dot lines. The container comprises an outer supporting rigid metal frame generally designated 3. A casing 4 is arranged within the frame. The supporting frame 3 comprises two end frame members 5 located each at one of the container short ends, and two side frame members 6 arranged along each of the container long sides and rigidly connected to said end frame members 5. The end frame members are rectangular and made of a hollow square section. Each side frame member 6 has two end parts 6' and a central part 6'' offset in parallel relative to said end parts. The central part 6'' is rigidly connected to the end parts 6' by means of oblique connecting parts 7, 7'. The lower edge of the end frame members 5 and the lower side of the central parts 6'' of the side frame members lie in a common plane and are located at such a distance below the lower outer contour of the casing that a space is formed underneath the casing for recesses 8 in each central part, said recesses being connected in pairs with guides 9 in the form of rectangular hollow sections or tubes for the fork arms of a forklift truck or the like. The fork arm recesses 8 preferably are four in number and arranged in pairs symmetrically around the container center. Lifting lugs 10, 10' are mounted on the oblique connecting parts 7, 7'. On the upper side of the rectangular end frames 5 (see FIG. 3), male members 11 are provided for cooperation with corresponding female members 12 on the lower sides of the end frames when several containers are stacked upon each other.

Figure 5:
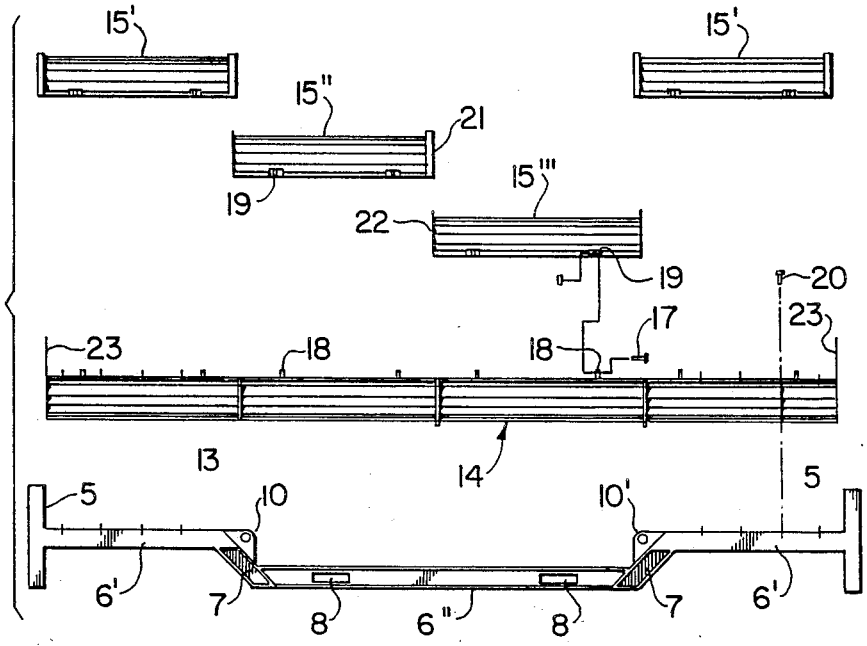
FIG. 5 is an exploded view of the container main parts.

The casing 4 comprises a continuous semicylindrical bottom part 14 composed of four corrugated standard type sheet metal plates interconnected by welding to semicircular horseshoe-shaped connecting members 13 located between the corrugated plates. The casing top 15 comprises four loose cover portions 15', 15'', 15''' which also consist of corrugated standard type sheet metal plates and have been given semicylindri-form in that they have been welded at their ends to semicircular horseshoe-shaped members 21, 22. Some members 21 are provided along their upper edge with a U-shaped fold to make them overlap and cover an adjacent member 22. The ends of the bottom part 14 are welded to circular sheet metal discs 23 having the same diameter as the outer diameter of the horse-shoe-shaped end members 22 and the connecting members 13. The cover portion 15' adjacent such a disc 23 also has a U-shaped fold overlapping the disc 23. Each longitudinal edge of a cover portion 15', 15'', 15''' has a pair of eyelets 19 cooperating with corresponding eyelets on a longitudinal flange 24 secured to each of the longitudinal edges of the bottom part 14. By means of these eyelets 18, 19, the cover portions 15 can be connected to the bottom part 14 by means of bolts 17 (see FIG. 5).

Figure 6:
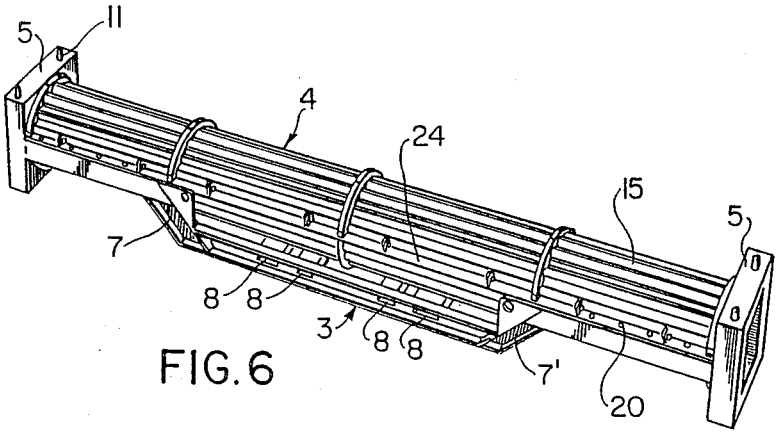
FIG. 6 is a perspective view of the container as seen obliquely from above.
Figure 7:
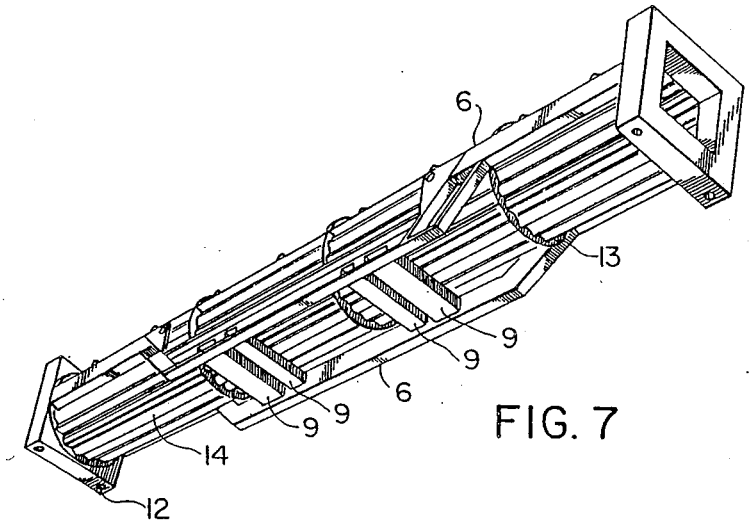
FIG. 7 is a perspective view of the container as seen obliquely from below.

When the bolts 17 are removed on one side, the eyelets 18 and 19, together with the bolts 17 on the opposite side of the cover portion, will form hinges so that the cover portion can be swung up in an optional direction. The flange 24 also serves to secure the casing to the end members 6' of the side frame member by means of a number of bolts 20; see FIGS. 5 and 6. In the area of the central part 6'' of the side frame member, the casing is, in principle, self-supporting, although it is possible to enlarge the connecting member 13 outwardly so that it supports itself on the central part 6''.

Figure 1:
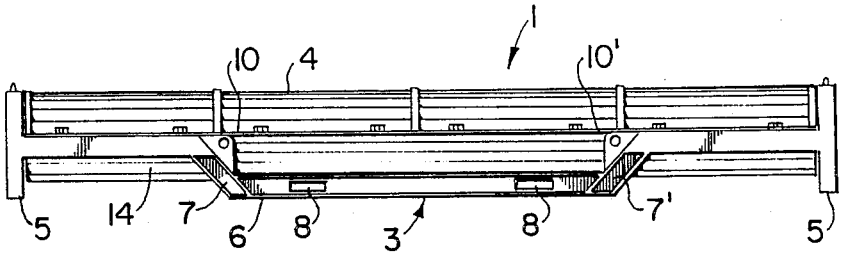
FIG. 1 is a side view of a transport container according to the invention.
Figure 2:
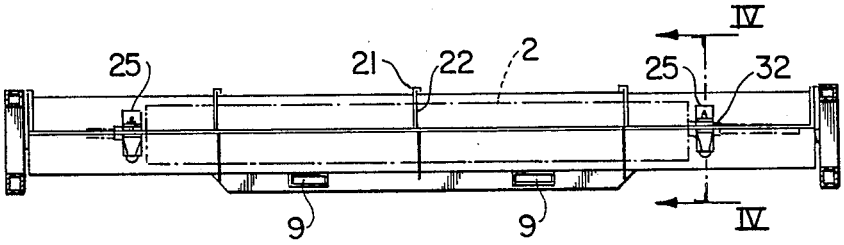
FIG. 2 is a longitudinal section of the container shown in FIG. 1.
Figure 4:
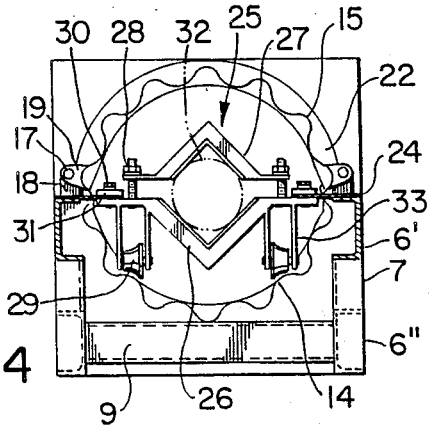
FIG. 4 is an enlarged section IV—IV in FIG. 2.

Within the casing, two clamping devices 25 are mounted whose construction is best seen from FIG. 4. These clamping devices 25 are designed to hold a shaft 32 of the roll 2, as shown by dash-dot lines in FIGS. 2 and 4. The flange 24 is so wide that it projects a distance into the casing, and the projecting part is used for fixing the clamping device 25. The clamping device comprises a lower part 26 having a V-shaped portion, and an upper part 27 having a portion in the form of an inverted V, between which the shaft journals 32 projecting from the roll ends can be firmly clamped in position by means of bolts 28. The lower part 26 of the clamping device is provided with wheels 29 mounted on projections 33 and resting on the bottom part 14 of the casing 4 in the lowered position of the clamping device. The lower part 26 of the clamping device 25 overlaps the lower side of the flange 24 over a given distance. On the inner side of the flange 24, a bolt 30 is threaded into the lower part 26 on both sides thereof near the inner edge of the flange 24. The bolt 30 extends through an abutment 31 overlapping the upper side of the flange 24. In the untensioned state of the bolts 30, the lower part 26 is lowered into the container, such that the wheels 29 will engage the interior of the casing. At the same time, the lower part 26, and thus the entire clamping device, is of course released from the flange 24, which means that the clamping devices and the roll clamped thereby can be displaced on the wheels 29 in the longitudinal direction of the container. In this manner, the center of gravity of the roll can be transferred to lie near the center of the container. When the roll is in the desired position in the container, the bolts 30 are tensioned, and the lower part 26 of the clamping device is raised into engagement with the lower side of the flange 24 in a raised position in which the wheels 29 are disengaged from the inner side of the bottom part 14. At the same time, the clamping device will be fixed relative to the flange 24 and, thus, also relative to the container in its entirety in that the inner edge of the flange is clamped between the lower part 26 of the clamping device 25 and the clamping plate 31.

The outer frame 3 is preferably made of steel, and the casing 4 of corrugated steel plate. The number of the casing sections is four mainly because use has been made cf corrugated standard sheet metal plates of the type which is used for road culverts and normally has a thickness of 2.6 mm and whose total length is well in agreement with standard rolls for papermaking machines. A wall thickness of 2.6 mm in the casing is quite adequate for a satisfactory protection of the roll surface, simultaneously as each of the four cover portions is given a weight sufficiently low to ensure ease of handling.

The transport container according to the invention has considerable advantages as compared with prior art wooden boxes. The container may be reused a practically unlimited number of times, which means that the packaging costs for each transport will be very low, even though the container is somewhat more expensive than a corresponding wooden box. The outer rigid and self-supporting frame can withstand heavy stresses, especially upon loading and unloading of the container with its contents, simultaneously as the casing effectively protects the roll surface. Furthermore, opening and unpacking of the container is extremely simple, and at the same time the handling of the container during loading and unloading, either by crane or by fork-lift truck, is greatly simplified since the lifting eyes and guides for the fork arms can be placed in convenient positions. It should be pointed out in the context that the container can be readily lifted by means of a fork-lift truck, even if it should have been turned upside down upon unloading or loading since the entire weight of the roll is transferred directly to the outer frame. Another great advantage during handling is the possibility of displacing the roll within the containers so that its center of gravity will be in the most favourable position relative to the position of the lifting eyes or the fork arm guides. In view of the great weight of the roll and the large extent of the container, which in the embodiment illustrated amounts to about seven meters, there is a risk that the fork-lift truck may overturn if the roll is subjected to an eccentric load.

POSSIBLE MODIFICATION OF THE INVENTION

The invention may, of course, be modified in various ways within the scope of the appended claims. For example, the casing can be made completely or partly of glass fiber-reinforced plastic or of sheet metal laminated with foamed plastic. If the roll has no protective layer when packed, the casing can be lined with foamed plastic or wood, or similar material. The bottom part of the casing may also be provided with longitudinal tubes on the sheet metal surface, serving as carriers for the wheels of the clamping devices, which in that case will not be in direct engagement with the sheet metal. Also, the casing need not be cylindrical. The end frame members need not be square; they may just as well be octagonal or circular. The central part of the side frame members may consist of several portions offset in parallel both upwardly and downwardly, if desired, thereby to lend better protection also to the casing top. The frame may, of course, have several side frame members on both sides. The fork recesses in the frame may be designed differently and located in other positions than those illustrated in the preferred embodiment. The clamping devices are shown to directly support a roll shaft, but may of course comprise a suitably removable part directly adapted to the shaft diameter. In the event that the shaft bearings stay on the roll taken out of the machine, the clamping devices are preferably used to hold the bearings. Furthermore, the clamping devices may act directly upon the roll if the shaft does not go with the removed roll, or if the roll does not have a shaft. The connecting parts 7, 7' need, of course, not to be oblique but can be arranged at right angles to the remaining parts of the side frame members, or in some other suitable manner. It is also possible to use the container for long objects other than rolls for papermaking machines, for example rolls of printing machines or other vulnerable objects. It is also possible to use other devices for fixing the shaft within the casing than the type of clamping devices exemplified.

We claim:

1. A container for transporting long, preferably cylindrical objects (2), especially rolls for papermaking machines, comprising on the one hand an outer supporting rigid metal frame (3) and, on the other hand, a nonsupporting casing (4) protecting the object, characterising in that the frame (3) comprises end frame members (5) at each short end of the container and side frame members (6) arranged along each of the container long sides and connected to said end frame members (5), and that the casing (4) comprises both a preferable semicylindrical continuous bottom part (14) which is suspended in the side frame members (6), and one or more, preferably semicylindrical top parts (15) detachably connected to the bottom part (14), and that there are provided within said casing (4) at least two devices (25) secured to said side frame members and adapted to fix the object (2) in transport position.

2. A transport container as claimed in claim 1, characterised in that each of said side frame members (6) comprises a central part (6″) and two end parts (6′), said central part being offset in parallel downwardly relative to said end parts (6′) and connected thereto by means of preferably oblique connecting parts (7, 7′), such that said end parts (6′) are located on a level with the center of the casing (4), while the center part (6″) is located underneath and outside the outer contour of the casing.

3. A transport container as claimed in claim 2, characterised in that the central parts (6″) of said side frame members have at least two, preferably four recesses (8) for the fork of a fork-lift truck or the like, the recesses on one side of the container being located opposite to the recesses on the other container side, and are connected therewith by means of tubular guides (9) for the fork arms.

4. A transport container as claimed claim 1, characterised in that the frame (3) has lifting lugs (10, 10′).

5. A transport container as claimed in claim 2, characterised in that said end frame members (5) are in the form of square or rectangular frames whose outer contours are tangent to and/or lie outside the outer contour of a cross-section of the casing (4), and whose lower horizontal parts are located at a distance outside the abovementioned outer contour of the casing (4) and on a level with said central parts (6′), and are provided on their lower surfaces with female members (12) adapted to cooperate with male members (11) provided on the upper side of the top sides of said end frame, when several containers are stacked upon one another.

6. A transport container as claimed in claim 5, characterised in that the casing (4) is formed of corrugated or sectional sheet metal, preferably of standard type, the corrugations of which are arranged in the longitudinal extent on the casing.

7. A transport container as claimed in claim 6, characterised in that the fixing devices (25) are displaceable and lockable in the longitudinal direction of the casing to facilitate displacement of the center of gravity of the long object (2).

8. A transport container as claimed in claim 7, characterised in that each fixing device comprises a lower wheeled part (26) and an upper part (27), said lower part (26) being raisable and lockable against longitudinal flanges (24) secured to the end parts (6′) of the side frame members, preferably by means of a bolt (30) threaded into said lower part and an abutment (31) on the upper side of said flanges, such that the wheels (29) of the said devices are raised out of engagement with a part of the casing (4) upon tensioning of said bolt (30).

* * * * *